US006088936A

United States Patent [19]

Bahl

[11] Patent Number: 6,088,936

[45] Date of Patent: Jul. 18, 2000

[54] SHOE WITH CLOSURE SYSTEM

[76] Inventor: Loveleen Bahl, 2009 122nd St. East C12, Burnsville, Minn. 55337

[21] Appl. No.: 09/238,593

[22] Filed: Jan. 28, 1999

[51] Int. Cl.[7] ..... A43C 11/00; A43B 7/20

[52] U.S. Cl. ..... 36/50.1; 36/89

[58] Field of Search ..... 36/50.1, 50.5, 36/58.5, 58.6, 54, 89

[56] References Cited

U.S. PATENT DOCUMENTS

| | | |
|---|---|---|
| 2,483,525 | 10/1949 | Brust . |
| 2,806,300 | 9/1957 | Morgan, Jr. et al. . |
| 3,169,325 | 2/1965 | Fesl . |
| 3,333,304 | 8/1967 | Daddona, Jr. . |
| 4,053,995 | 10/1977 | Shein . |
| 4,142,307 | 3/1979 | Martin . |
| 5,181,331 | 1/1993 | Berger . |
| 5,467,537 | 11/1995 | Aveni et al. . |

FOREIGN PATENT DOCUMENTS

| | | |
|---|---|---|
| 792875 | 1/1936 | France . |
| 145154 | 10/1903 | Germany . |
| 88252 | 1/1937 | Sweden . |

*Primary Examiner*—Ted Kavanaugh

[57] ABSTRACT

A shoe with closure system for provides enhanced support for feet and ankles. The shoe with closure system includes an upper and a sole coupled to the upper. The upper has a toe portion, a top portion, a pair of lateral portions, an ankle portion, a heel portion, and a tongue. An elongate toe channel is coupled to the toe portion of the upper. A pair of elongate top channels are coupled to opposite sides of the top portion of the upper. A pair of elongate lateral channels are coupled to opposite sides of the lateral portion of the upper. A pair of elongate ankle channels are coupled to opposite sides of the ankle portion of the upper. A shoelace extends through the channels.

14 Claims, 2 Drawing Sheets

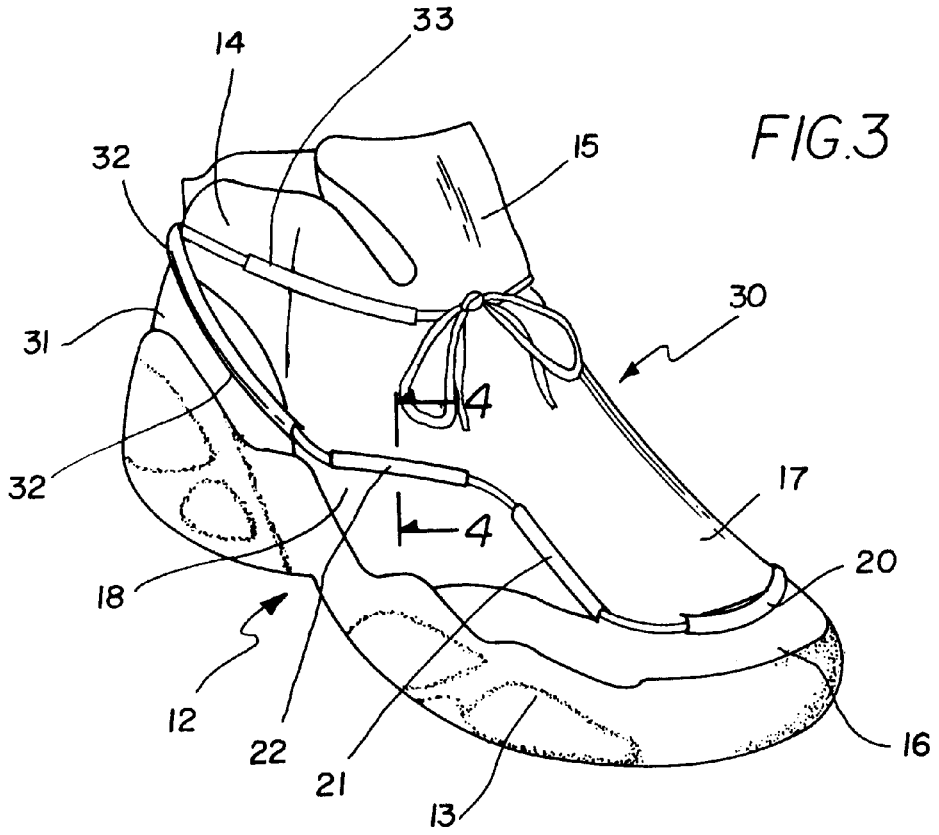
FIG.3
FIG.4
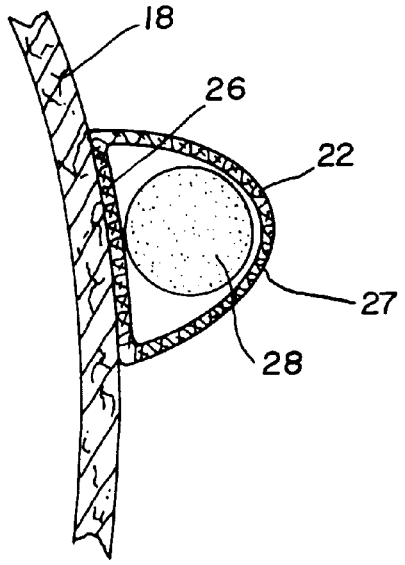

SHOE WITH CLOSURE SYSTEM

BACKGROUND OF THE INVENTION

1. Field of the Invention

The present invention relates to footwear and more particularly pertains to a new shoe with closure system for provides enhanced support for feet and ankles.

2. Description of the Prior Art

The use of footwear is known in the prior art. More specifically, footwear heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,942,678; U.S. Pat. No. 5,467,537; U.S. Pat. No. 4,870,761; U.S. Pat. No. 3,213,551; U.S. Pat. No. 2,164,465; and U.S. Pat. No. Des. 373,464.

While these devices fulfill their respective, particular objectives and requirements, the aforementioned patents do not disclose a new shoe with closure system. The inventive device includes an upper and a sole coupled to the upper. The upper has a toe portion, a top portion, a pair of lateral portions, an ankle portion, a heel portion, and a tongue. An elongate toe channel is coupled to the toe portion of the upper. A pair of elongate top channels are coupled to opposite sides of the top portion of the upper. A pair of elongate lateral channels are coupled to opposite sides of the lateral portion of the upper. A pair of elongate ankle channels are coupled to opposite sides of the ankle portion of the upper. A shoelace extends through the channels.

In these respects, the shoe with closure system according to the present invention substantially departs from the conventional concepts and designs of the prior art, and in so doing provides an apparatus primarily developed for the purpose of provides enhanced support for feet and ankles.

SUMMARY OF THE INVENTION

In view of the foregoing disadvantages inherent in the known types of footwear now present in the prior art, the present invention provides a new shoe with closure system construction wherein the same can be utilized for provides enhanced support for feet and ankles.

The general purpose of the present invention, which will be described subsequently in greater detail, is to provide a new shoe with closure system apparatus and method which has many of the advantages of the footwear mentioned heretofore and many novel features that result in a new shoe with closure system which is not anticipated, rendered obvious, suggested, or even implied by any of the prior art footwear, either alone or in any combination thereof.

To attain this, the present invention generally comprises an upper and a sole coupled to the upper. The upper has a toe portion, a top portion, a pair of lateral portions, an ankle portion, a heel portion, and a tongue. An elongate toe channel is coupled to the toe portion of the upper. A pair of elongate top channels are coupled to opposite sides of the top portion of the upper. A pair of elongate lateral channels are coupled to opposite sides of the lateral portion of the upper. A pair of elongate ankle channels are coupled to opposite sides of the ankle portion of the upper. A shoelace extends through the channels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe with closure system apparatus and method which has many of the advantages of the footwear mentioned heretofore and many novel features that result in a new shoe with closure system which is not anticipated, rendered obvious, suggested, or even implied by any of the prior art footwear, either alone or in any combination thereof.

It is another object of the present invention to provide a new shoe with closure system which may be easily and efficiently manufactured and marketed.

It is a further object of the present invention to provide a new shoe with closure system which is of a durable and reliable construction.

An even further object of the present invention is to provide a new shoe with closure system which is susceptible of a low cost of manufacture with regard to both materials and labor, and which accordingly is then susceptible of low prices of sale to the consuming public, thereby making such shoe with closure system economically available to the buying public.

Still yet another object of the present invention is to provide a new shoe with closure system which provides in the apparatuses and methods of the prior art some of the advantages thereof, while simultaneously overcoming some of the disadvantages normally associated therewith.

Still another object of the present invention is to provide a new shoe with closure system for provides enhanced support for feet and ankles.

Yet another object of the present invention is to provide a new shoe with closure system which includes an upper and a sole coupled to the upper. The upper has a toe portion, a top portion, a pair of lateral portions, an ankle portion, a heel portion, and a tongue. An elongate toe channel is coupled to the toe portion of the upper. A pair of elongate top channels are coupled to opposite sides of the top portion of the upper. A pair of elongate lateral channels are coupled to opposite sides of the lateral portion of the upper. A pair of elongate ankle channels are coupled to opposite sides of the ankle portion of the upper. A shoelace extends through the channels.

Still yet another object of the present invention is to provide a new shoe with closure system that utilizes elongate channels instead of eyelets to permit more controlled .

Even still another object of the present invention is to provide a new shoe with closure system that reduces the chance of injury.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of an alternate embodiment of the present invention.

FIG. 4 is a schematic cross-sectional view of the present invention taken from line 4—4 of FIG. 3.

DESCRIPTION OF THE PREFERRED EMBODIMENT

Figure 1:
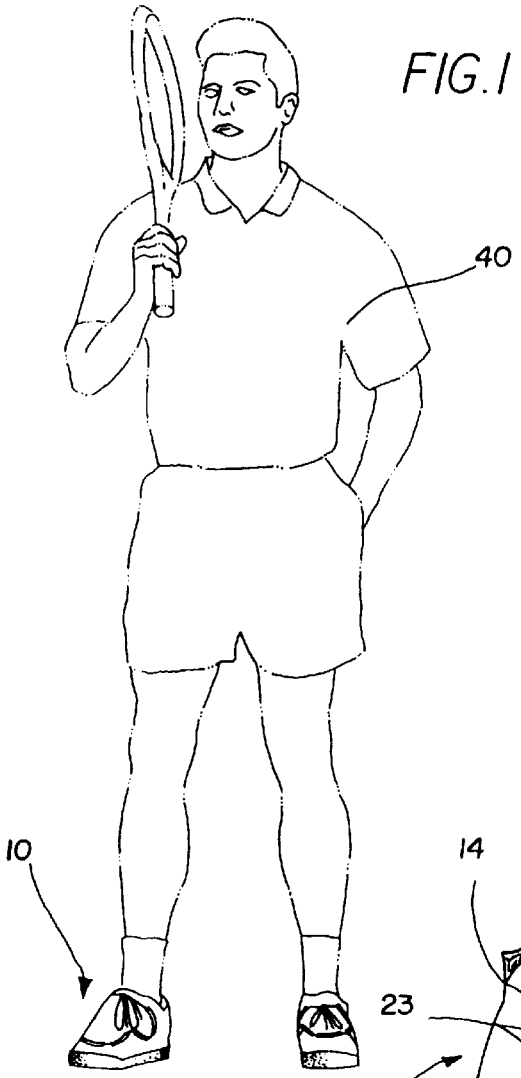
FIG. 1 is a schematic perspective view of a new shoe with closure system according to the present invention.

With reference now to the drawings, and in particular to FIGS. 1 through 4 thereof, a new shoe with closure system embodying the principles and concepts of the present invention and generally designated by the reference numeral 10 will be described.

Figure 2:
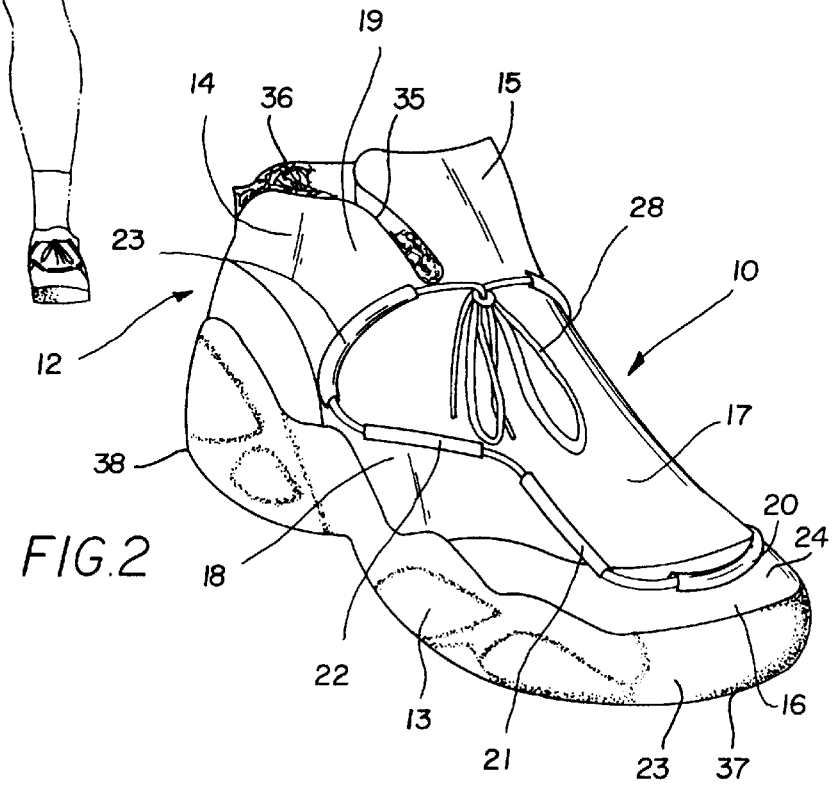
FIG. 2 is a schematic perspective view of the present invention.

As best illustrated in FIGS. 1 through 4, the shoe with closure system 10 generally comprises an upper 14 and a sole 13 coupled to the upper 14. The upper 14 has a toe portion 16, a top portion 17, a pair of lateral portions 18, an ankle portion 19, a heel portion 31, and a tongue 15. An elongate toe channel 20 is coupled to the toe portion 16 of the upper 14. A pair of elongate top channels 21 are coupled to opposite sides of the top portion 17 of the upper 14. A pair of elongate lateral channels 22 are coupled to opposite sides of the lateral portion of the upper 14. A pair of elongate ankle channels 32 are coupled to opposite sides of the ankle portion 19 of the upper 14. A shoelace 28 extends through the channels without crossing until the knot, as shown in FIG. 2.

Preferably, the toe channel 20 has opposed ends. A length of the toe channel 20 is defined between the ends of the toe channel 20. The toe channel 20 is arcuate along its length and opens towards the top portion 17 generally following the contour of the front tip 25 of the shoe 12.

Ideally, a width of the upper 14 is defined between the lateral sides thereof at the widest point of the shoe 12. The length of the toe channel 20 is between about ¼ and equal to the width of the upper 14. Most ideally, the length of the toe channel 20 is between ⅓ and ½ the width of the upper 14, as shown in FIG. 1.

Preferably, each of the top channels 21 has opposite ends. A length of each of the top channels 21 is defined between its ends. The top channels 21 are generally straight along their lengths. Ideally, each of the top channels 21 lies on a plane parallel to a line (not shown) extending through a front portion 35 of a top rim 36 of the ankle portion 19 and a lower front tip 37 of the sole 13.

Ideally, a length of the upper 14 is defined between the toe portion 16 and the heel portion 31 thereof at the widest point of the shoe. The length of each of the top channels 21 is between about 1/10 and ¼ the length of the upper 14. Most ideally, the length of each of the top channels 21 is between ⅛ and ⅙ the length of the upper 14.

Preferably, each of the lateral channels 22 has opposite ends. A length of each of the lateral channels 22 is defined between its end. The lateral channels 22 are generally straight along its length. More preferably, each of the lateral channels 22 are angled downwardly towards a heel tip 38 of the sole 13 at about an angle of between about 15 degrees and 45 degrees, ideally about 30 degrees.

Ideally, the length of each of the lateral channels 22 is between about 1/10 and ¼ the length of the upper 14. Most ideally, the length of each of the lateral channels 22 is between ⅛ and ⅙ the length of the upper 14 and about 19/20 the length of each of the top channels 21.

As shown in FIG. 1, a pair of elongate ankle channels 23 are coupled to opposite sides of the ankle portion 19 of the upper 14. Each of the ankle channels 23 has opposite ends. A length of each of the ankle channels 23 is defined between its ends. Each of the ankle channels 23 are generally arcuate along its length and opens towards the top portion 17. Upper 14 ends of the ankle channels 23 face each other.

Ideally, the length of each of the ankle channels 23 is between about 1/10 and ¼ the length of the upper 14. Most ideally, the length of each of the ankle channels 23 is between ⅐ and ⅕ the length of the upper 14 and about ⅘ the length of each of the top channels 21.

In an alternate embodiment 30, as shown in FIG. 3, the shoelace 28 crosses behind the heel portion 31 and extends forward towards the tongue 15 of the shoe. The pair of elongate ankle channels 32 are coupled to opposite sides of the ankle portion 19 of the upper 14 and extend onto the heel portion 31. A pair of elongate upper channels 33 are coupled to opposite sides of the upper 14 of the shoe 12 to provide increased support to the ankles of a wearer. The shoelace is tied together over the top portion 17 towards the tongue 15.

Each of the ankle channels 32 has opposite ends and a length of each of the ankle channels 32 is defined between its ends. The ankle channels 32 are generally straight along their lengths. Each of the ankle channels 32 are angled upwardly from front to back towards an upper rear tip of the ankle portion 19 at about an angle of between about 10 degrees and 45 degrees, ideally about 25 degrees. Ideally, the length of each of the ankle channels 32 are between about ⅛ and ⅓ the length of the upper 14, most ideally between ⅙ and ¼ the length of the upper 14.

Preferably, each of the channels comprises a sidewall 27 and a generally rectangular base wall 26 that extends between opposite sides of the sidewall 27. Each of the base wall 26*s* are coupled to an associated portion of the upper 14.

Each of the sidewall 27*s* has a generally arch-shaped transverse cross section. FIG. 4 shows an exemplary construction of one of the lateral channels 22, which is equally applicable to all of the channels.

Also preferably, the toe portion 16 comprises a reinforced layer 24 that extends from the sole 13 towards the top portion 17. The toe channel 20 is coupled to the reinforced layer 24. The reinforced layer 24 adds strength to the toe portion 16 so that it doesn't become disattached from the sole 13 due to the increased stresses placed on the toe portion 16.

In use, the shoelace 28 is fed through the various channels, as shown in FIG. 2 or 3, depending on the embodiment. The ends of the shoelace 28 are pulled away from the upper 14 to stretch it tight, thereby pulling the channels towards a center of the shoe as well as towards each other to tighten the upper 14 around a foot to provide more support to the ankle and the foot than traditional criss-cross lacing through opposed eyelets.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe construction, comprising:

an upper and a sole coupled to said upper;

said upper having a toe portion, a top portion, a pair of lateral portions, an ankle portion, and a heel portion, said upper having a leg opening through which a wearer's leg extends during wearing;

an elongate toe channel being coupled to said toe portion of said upper;

a pair of elongate top channels being coupled to opposite sides of said top portion of said upper;

a pair of elongate lateral channels being coupled to opposite sides of said lateral portion of said upper;

a pair of elongate ankle channels being coupled to opposite sides of said ankle portion of said upper;

a pair of elongate upper channels being coupled to opposite sides of said upper;

a single continuous shoelace extending through said channels; and wherein said ankle and upper channels form a path for said single continuous shoelace circumscribing said leg opening for enhancing a snug fit of said upper on a wearers ankle when said single continuous shoe lace is drawn tight.

2. The shoe construction of claim 1, wherein said toe channel has opposed ends, a length of said toe channel being defined between said ends thereof, said toe channel being arcuate along the length thereof and opening towards said top portion generally following a contour of said toe portion.

3. The shoe construction of claim 2, wherein a width of said upper is defined between said lateral sides thereof, the length of said toe channel being between about ¼ and equal to the width of said upper.

4. The shoe construction of claim 1, wherein each of said top channels has opposite ends, a length of each of said top channels being defined between said ends thereof, said top channels being generally straight along the length thereof, wherein each of said top channels lies on a plane parallel to a line extending through a front portion of a top rim of said ankle portion and a lower front tip of said sole.

5. The shoe construction of claim 4, wherein a length of said upper is defined between said toe portion and said heel portion thereof, the length of each of said top channels being between about 1/10 and ¼ the length of said upper.

6. The shoe construction of claim 1, wherein each of said lateral channels has opposite ends, a length of each of said lateral channels being defined between said ends thereof, said lateral channels being generally straight along the length thereof, wherein each of said lateral channels is angled downwardly towards a heel tip of said sole at about an angle of between about 15 degrees and 45 degrees.

7. The shoe construction of claim 6, wherein a length of said upper is defined between said toe portion and said heel portion thereof, the length of each of said lateral channels being between about 1/10 and ¼ the length of said upper.

8. The shoe construction of claim 1, wherein each of said ankle channels has opposite ends, a length of each of said ankle channels being defined between said ends thereof, said ankle channels being generally straight along the length thereof, wherein each of said ankle channels is angled upwardly towards an upper rear tip of said ankle portion at about an angle of between about 10 degrees and 45 degrees.

9. The shoe construction of claim 8, wherein the length of each of said ankle channels is between about ⅛ and ⅓ the length of said upper.

10. The shoe construction of claim 8, further comprising a pair of elongate upper channels being coupled to opposite sides of an upper of said shoe for providing increased support to an ankle of a wearer.

11. The shoe construction of claim 1, wherein each of said channels comprises a sidewall and a base wall extending between opposite sides of said sidewall, each of said base walls being coupled to an associated portion of said upper.

12. The shoe construction of claim 11, wherein each of said sidewalls has a generally arch-shaped transverse cross section.

13. The shoe construction of claim 1, wherein said toe portion comprises a reinforced layer being extended from said sole towards said top portion, said toe channel being coupled to said reinforced layer.

14. A shoe construction, comprising:

an upper and a sole coupled to said upper;

said upper having a toe portion, a top portion, a pair of lateral portions, an ankle portion, and a heel portion, said upper having a leg opening through which a wearer's leg extends during wearing;

an elongate toe channel being coupled to said toe portion of said upper;

said toe channel having opposed ends, wherein a length of said toe channel is defined between said ends thereof;

said toe channel being arcuate along the length thereof and opening towards said top portion generally following a contour of said toe portion;

wherein a width of said upper is defined between said lateral sides thereof;

the length of said toe channel being between about ¼ and equal to the width of said upper;

a pair of elongate top channels being coupled to opposite sides of said top portion of said upper;

each of said top channels having opposite ends, wherein a length of each of said top channels is defined between said ends thereof;

said top channels being generally straight along the length thereof, wherein each of said top channels lies on a plane parallel to a line extending through a front portion of a top rim of said ankle portion and a lower front tip of said sole;

wherein a length of said upper is defined between said toe portion and said heel portion thereof;

the length of each of said top channels being between about 1/10 and ¼ the length of said upper;

a pair of elongate lateral channels being coupled to opposite sides of said lateral portion of said upper;

each of said lateral channels having opposite ends, wherein a length of each of said lateral channels is defined between said ends thereof;

said lateral channels being generally straight along the length thereof, wherein each of said lateral channels is angled downwardly towards a heel tip of said sole at about an angle of between about 15 degrees and 45 degrees;

the length of each of said lateral channels being between about 1/10 and ¼ the length of said upper;

a pair of elongate ankle channels being coupled to opposite sides of said ankle portion of said upper;

a pair of elongate upper channels being coupled to opposite sides of said upper;

wherein each of said ankle channels has opposite ends, a length of each of said ankle channels being defined between said ends thereof, said ankle channels being generally straight along the length thereof, wherein each of said ankle channels is angled upwardly towards an upper rear tip of said ankle portion at about an angle of between about 10 degrees and 45 degrees;

wherein the length of each of said ankle channels is between about ⅛ and ⅓ the length of said upper;

a pair of elongate upper channels being coupled to opposite sides of an upper of said shoe for providing increased support to an ankle of a wearer;

each of said channels comprising a sidewall and a base wall extending between opposite sides of said sidewall, each of said base walls being coupled to an associated portion of said upper, each of said sidewalls having a generally arch-shaped transverse cross section;

a single continuous shoelace extending through said channels;

said toe portion comprising a reinforced layer being extended from said sole towards said top portion, said toe channel being coupled to said reinforced layer; and wherein said ankle and upper channels form a path for said single continuous shoelace circumscribing said leg opening for enhancing a snug fit of said upper on a wearers ankle when said single continuous shoe lace is drawn tight.

* * * * *